US006343952B1

(12) United States Patent
Fukuda

(10) Patent No.: US 6,343,952 B1
(45) Date of Patent: Feb. 5, 2002

(54) WATERPROOF CONNECTOR

(75) Inventor: Masaru Fukuda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/349,928

(22) Filed: Jul. 8, 1999

(30) Foreign Application Priority Data

Jul. 9, 1998 (JP) ..... 10-194719

(51) Int. Cl.[7] ..... H01R 13/40
(52) U.S. Cl. ..... 439/587
(58) Field of Search ..... 439/587, 274, 439/275

(56) References Cited

U.S. PATENT DOCUMENTS

| | | | | | |
|---|---|---|---|---|---|
| 5,295,865 | A | * | 3/1994 | Endo et al. | 439/587 |
| 5,351,973 | A | * | 10/1994 | Taniuchi et al. | 439/587 |
| 5,586,916 | A | | 12/1996 | Shinji et al. | |
| 5,928,033 | A | * | 7/1999 | Kato et al. | 439/587 |
| 5,931,699 | A | * | 8/1999 | Saito | 439/587 |
| 5,934,938 | A | * | 8/1999 | Clark et al. | 439/587 |
| 5,980,316 | A | * | 11/1999 | Shinchi | 439/587 |

FOREIGN PATENT DOCUMENTS

| | | |
|---|---|---|
| DE | 4015793 | 12/1990 |
| EP | 0 549 269 A1 | 6/1993 |
| EP | 0 631 344 A2 | 12/1994 |
| JP | 4-49480 | 4/1992 |
| JP | 5-152028 | 6/1993 |
| JP | 7-22079 | 1/1995 |
| JP | 10-60096 | 3/1998 |
| WO | WO 96/29760 | 9/1996 |

* cited by examiner

*Primary Examiner*—Brian Sircus
*Assistant Examiner*—Phuong K T Dinh
(74) *Attorney, Agent, or Firm*—Finnegan, Henderson, Farabow, Garrett & Dunner, L.L.P.

(57) ABSTRACT

An inner housing (12) is formed with terminal accommodation chambers (13) for accommodating terminals (14) at ends of electric wires (20). An outer housing (4) is fitted on the inner housing. The outer housing has a bottom wall portion (47) formed with wire insertion holes (48) in opposition to the terminal accommodation chambers. A waterproof rubber plug (6) is interposed between the inner housing and the bottom wall portion for sealing the terminal accommodation chambers. A spacer (5) has a hollow trunk portion (40) fitted on the inner housing and adapted to be fitted together with the inner housing into the outer housing, and a rubber plug retaining portion (41) for retaining the waterproof rubber plug plugged thereto to be supported in a close contacting manner. The bottom wall portion is separable along a separation plane (S1, S2) passing the wire insertion holes.

5 Claims, 4 Drawing Sheets

WATERPROOF CONNECTOR

BACKGROUND OF THE INVENTION

1. Field of the Invention

The present invention relates to a waterproof connector of a compact multi-polar type that has an enhanced waterproof nature between a connector housing assembly and a plurality of electric wires provided with terminals attached to their ends.

2. Description of the Relevant Art

Such a type of waterproof connector is disclosed in Japanese Patent Application No. 10-60096 filed in Japan by the assignee of the present application.

This waterproof connector comprises: a connector housing assembly having a terminal accommodating cavity and a number of separated wire leading cavities which communicate with outside via a number of diameter-reduced wire insertion holes formed in an outer wall of the housing assembly and with the terminal accommodating cavity via a number of diameter-reduced wire insertion holes formed in an inner wall of the housing assembly; a number of waterproof rubber plugs fitted watertight in the wire leading cavities and formed with wire leading holes; a number of female terminals set in positions in the terminal accommodating cavity; and a number of insulated electric wires provided through the wire insertion holes at the outer end, the wire leading holes in the rubber plugs and the wire insertion holes at the inner end, and connected at their ends to the terminals.

The housing assembly comprises a synthetic-resin-made inner housing, a synthetic-resin-made outer housing loose-fitted on the inner housing, and a synthetic-resin-made spacer inserted tight between the inner and outer housings. The outer housing has a rear wall portion constituting the above-mentioned outer wall formed with the wire insertion holes at the outer end, and the spacer has a rear wall portion constituting the above-mentioned inner wall formed with the wire insertion holes at the inner end. The inner housing and the spacer as well as the outer housing have their front end faces exposed outside.

The terminal accommodating cavity is defined by the inner housing and the spacer, and is partitioned by walls into a number of terminal accommodation chambers for accommodating therein the female terminals. The wire leading cavities are defined by the outer housing and the spacer, and are sealed with the rubber plugs fitted therein.

The outer housing may be damaged for external causes, such as by undue forces, and may be replaced with new one. However, the waterproof connector has sealing rubber plugs, and such replacement needs cutting electric wires connected to female terminals or disconnecting the wires from the terminals before removal of the damaged outer housing or after disassembly of entire connector housing, as well as re-connecting the wires to the terminals before re-assembly of the connector housing. Such services for maintenance takes a significant amount of man-hours.

SUMMARY OF THE INVENTION

The present invention has been achieved with such points in view.

It therefore is an object of the present invention to provide a waterproof connector improved for replacement of a damaged outer housing member, by a possible separation before removal of the damaged member and installation of a new member, with an eliminated redundancy for wire disconnection and reconnection, without the need of disassembling and reassembling an entire connector.

To achieve the object, an aspect of the present invention provides a waterproof connector comprising an inner housing assembly for defining a terminal accommodation chamber, a rubber plug member for sealing a wire connection end of the terminal accommodation chamber watertight, and an outer housing member fitted on the inner housing assembly for holding the rubber plug member, the outer housing member being formed with a wire insertion hole and separable along a separation line passing the wire insertion hole.

According to this aspect of the invention, a waterproof connector is constituted with an inner housing assembly, an outer housing member fitted thereon, and a rubber plug member installed therebetween. The waterproof connector has an electric wire lead from outside, through a wire insertion hole of the outer housing member and the rubber plug member, inside a terminal accommodation chamber in the inner housing assembly, where it is connected to a terminal. The outer housing member may be damaged. However, this member is separable along its separation line passing the wire insertion hole. Separated pieces of the damaged member can be removed individually, to be replaced with those of a new outer housing member, which can be assembled along its separation line. An entirety of the inner housing assembly, which has the rubber plug member, the electric wire and the terminal assembled thereto, can be reused with an eliminated redundancy for wire disconnection and reconnection, without the need of dis-assembling and re-assembling the inner housing assembly.

Further, to achieve the object described, another aspect of the invention provides a waterproof connector comprising: an inner housing formed with terminal accommodation chambers for accommodating therein terminals at ends of electric wires; an outer housing fitted on the inner housing, the outer housing having a bottom wall portion formed with wire insertion holes in opposition to the terminal accommodation chambers; a waterproof rubber plug interposed between the inner housing and the bottom wall portion for sealing the terminal accommodation chambers; a spacer having a trunk portion fitted on the inner housing and adapted to be fitted together with the inner housing into the outer housing, and a rubber plug retaining portion for having the waterproof rubber plug inserted therein to be supported in a close contacting manner; and the bottom wall portion being separable along a separation plane passing the wire insertion holes.

According to this aspect of the invention, wire insertion holes become open, as a bottom wall portion of an outer housing is divided into complementary parts, allowing for electric wires to be removed or installed together with terminals placed in a combination of an inner housing and a spacer, as well as with a rubber plug attached to the spacer.

Accordingly, when damaged, the outer housing can be removed, without disassembling the spacer and the inner housing nor disconnecting the wires from the terminals. Then, the wires can be placed in divided wire insertion holes on a divided part of a new outer housing. Divided parts of this housing can then be assembled on the spacer, so that the wires are installed in completed wire insertion holes. The damaged outer housing can thus be replaced with the new one in a facilitated manner, permitting an improved handling for maintenance.

Further, a rubber plug retaining portion provided on the spacer comes into close contact with a waterproof rubber plug which has been inserted into the rubber plug retaining portion. Accordingly, the waterproof rubber plug can securely come into close contact with the wires in the insertion holes, thereby improving waterproof performance in the waterproof rubber plug.

BRIEF DESCRIPTION OF THE DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
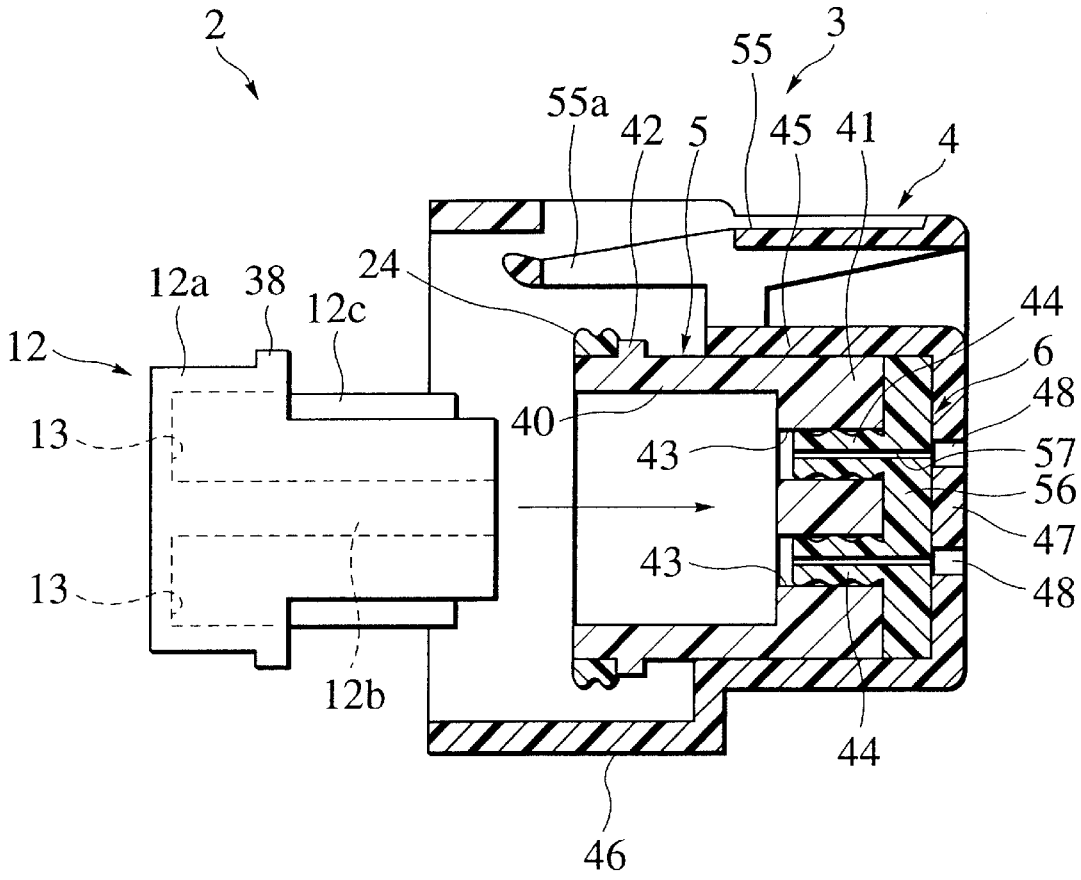
FIG. 1 is a longitudinal section of a waterproof connector according to an embodiment of the invention, as it is on the way of assemblage.

There will be detailed below the preferred embodiments of the present invention with reference to the accompanying drawings. Like members are designated by like reference characters.

Figure 2:
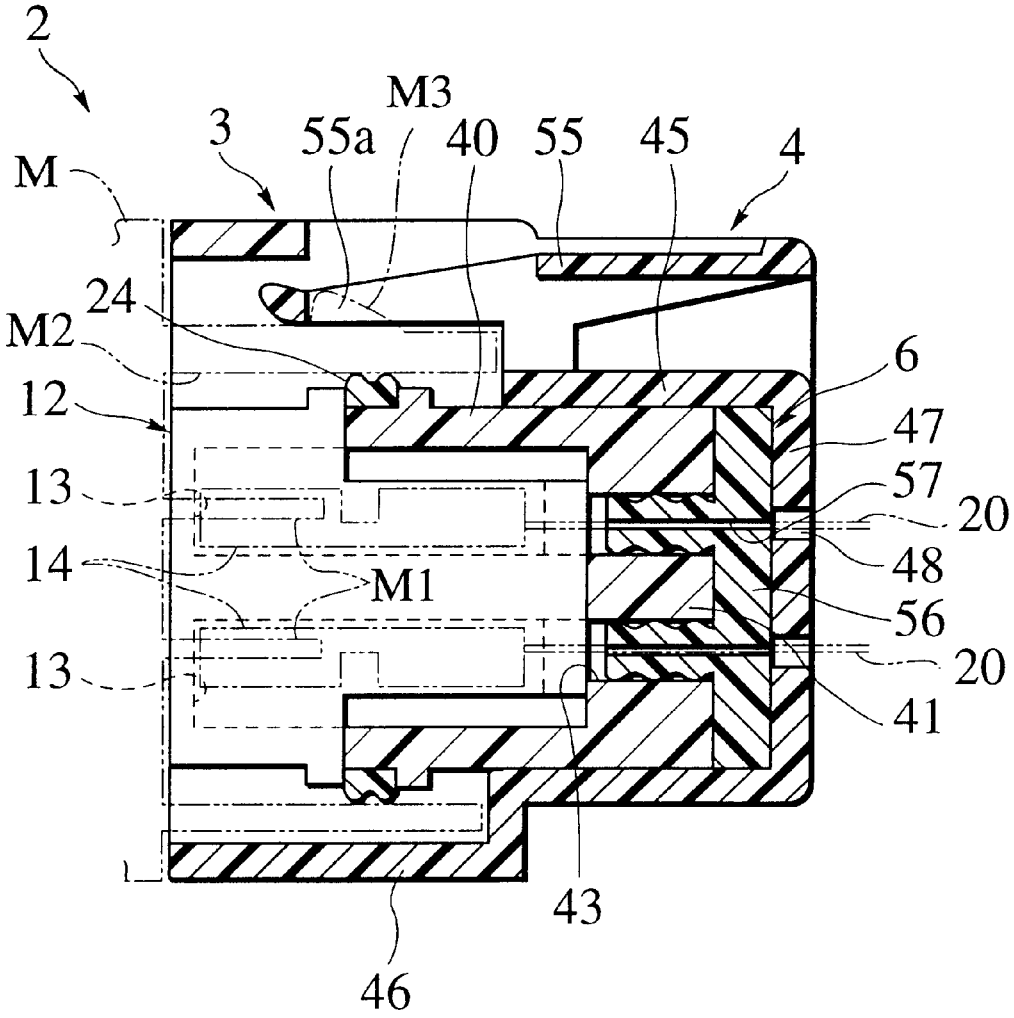
FIG. 2 is a longitudinal section of the waterproof connector of FIG. 1, as it is assembled.

FIG. 1 illustrates a waterproof male connector 2 according to an embodiment of the invention, on the way of assemblage, and FIG. 2, the waterproof connector 2 in an assembled state for connection with a mating waterproof female connector M.

As shown in FIG. 1, the waterproof connector 2 has a component-wise resin-molded connector housing 3 of a waterproof type that comprises a combination of an inner housing 12 and a spacer 5 to be fitted on the inner housing 12 to define therebetween a pair of upper and lower arrays of terminal accommodation chambers 13, and an outer housing 4 to be fitted on the spacer 5, with a waterproof rubber plug 6 intervening therebetween. The inner and outer housings 12 and 4 and the spacer 5 are each molded with a synthetic resin.

A pair of upper and lower arrays of insulation displacement type female terminals 14 are accommodated in the terminal accommodation chambers 13. Each terminal accommodation chamber 13 is defined with a wall of a front box portion 12*a* of the inner housing 12, a central horizontal wall 12*b* of the inner housing 12, neighboring two of upper and lower vertical partition walls 12*c* formed on upper and lower sides of the central horizontal wall 12*b*, an inside of a straight hollow trunk portion 40 of the spacer 5, and a rubber plug retaining portion 41 as a rear wall of the spacer 5. A front wall of the box portion 12*a* has a pair of upper and lower arrays of terminal insertion holes formed therethrough to allow mating male terminals M1 of the mating connector Ma to be inserted therethrough and received in corresponding female terminals 14. An enclosing wall of the box portion 12*a* has (a) continuous (or intermittent) projection(s) or rib(s) 38 formed on a rear edge thereof, for axially pressing a waterproof packing 24 fitted around a front edge of the trunk portion 40.

The spacer 5 comprises the trunk portion 40 of a substantially rectangular tubular configuration, and the rubber plug retaining portion 41 integrally closing a rear end of the trunk portion 40. The inner housing 12 is fitted inside the trunk portion 40. The front edge of the trunk portion 40 has (a) continuous (or intermittent) projection(s) or rib(s) 42 formed thereon, for cooperation with the rib(s) 38 to define therebetween (a) circumferential recess(es) for receiving the waterproof packing 24 to be fixed therein. The packing 24 may be a rubber ring to be compressed to effect a watertight sealing around the trunk portion 40, when an enclosing hood portion M2 of the mating connector M is inserted to be fitted thereon.

The rubber retaining-portion 41 of the spacer 5 comprises a relatively thick wall formed with a pair of upper and lower arrays of axial rubber plug insertion holes 43 in opposition to the terminal accommodation chambers 13. The waterproof rubber plug 6 comprises a "retained" portion 6 as a substantially rectangular common vertical base portion thereof, and a pair of upper and lower arrays of horizontal plug portions 44 integrally formed on a front side of the retained portion 6. The plug portions 44 are fitted watertight in the rubber plug insertion holes 43.

The outer housing 4 comprises a substantially rectangular tubular inner wall portion 45, and a substantially rectangular tubular outer wall portion 46 formed integrally with the inner wall portion 45, with increased outside dimensions. The inner wall portion 45 is closed at rear end with a bottom wall portion 47.

Figure 3:
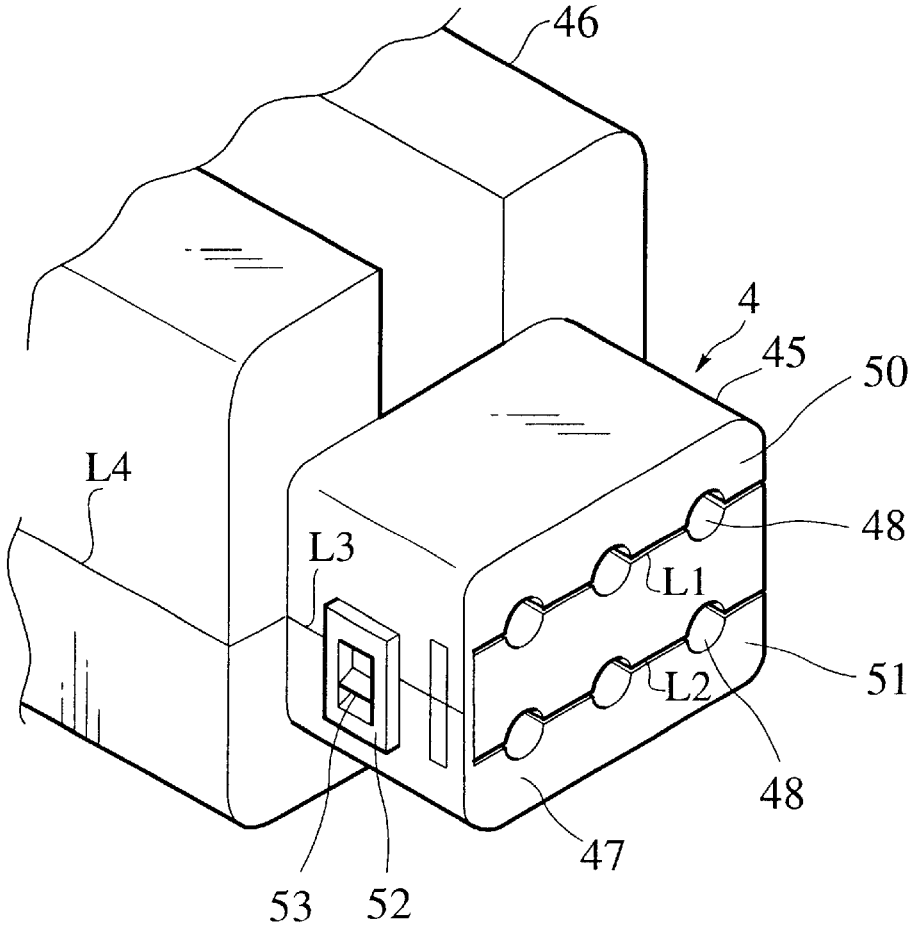
FIG. 3 is a fragmentary perspective view of an outer housing of the waterproof connector of FIG. 1.
Figure 4:
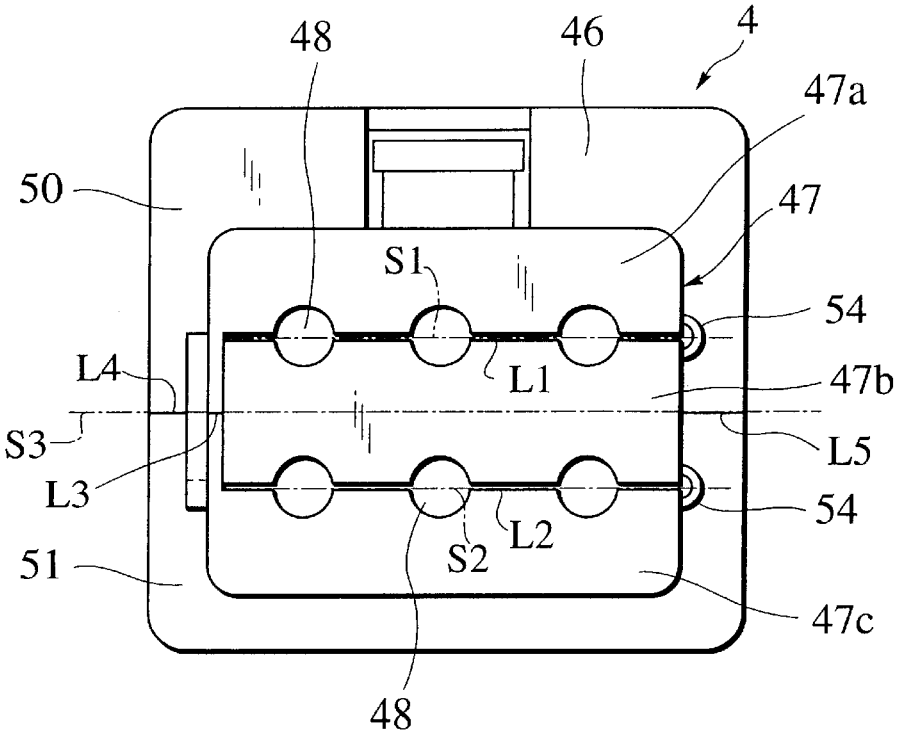
FIG. 4 is a rear view of the outer housing of FIG. 3, as it is closed.
Figure 5:
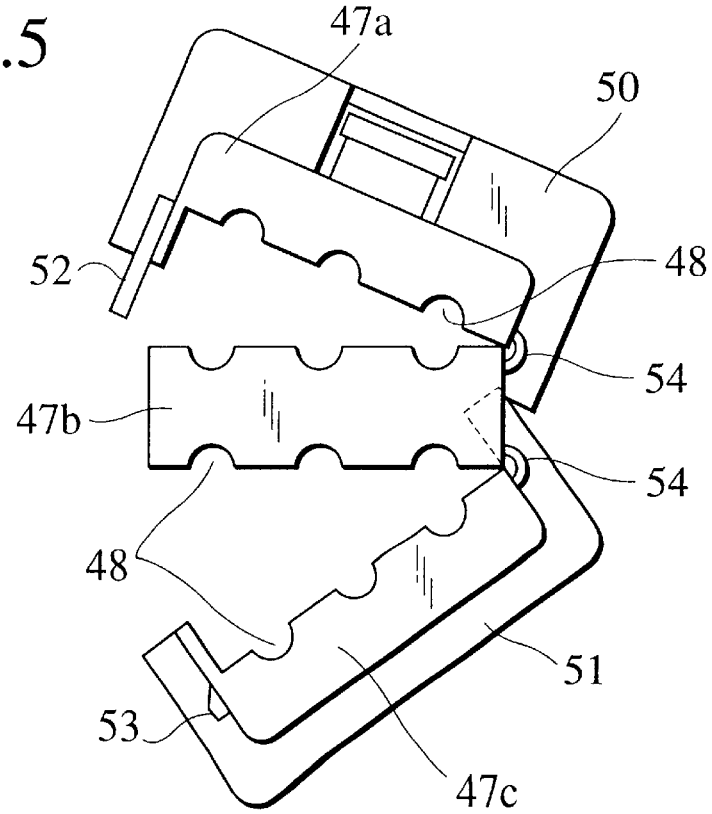
FIG. 5 is a rear view of the outer housing of FIG. 3, as it is open.

As shown in FIGS. 3 to 5, the outer housing 4 is divided for separation along substantially horizontal separation lines L1 to L5, into two principal parts (50, 51) and an intermediate single piece (47*b*). Separation lines L1 and L2 traverse a rear surface of the bottom wall portion, passing respective wire insertion holes 48, turn forwards at their left ends (right-hand in FIGS. 3–5), and traverse a hinged-side surface of the inner wall portion 45 of the outer housing 4, before turning downwards or upwards to join with separation line L5 of a left (right in FIGS. 3–5) half of the outer wall portion 46 of the outer housing 4. The lines L1 and L2 are bent downwards or upwards at their right ends (left-handed in FIGS. 3–5), to join with separation line L3 of a right (left in FIGS. 3–5) wall of the inner wall portion 45. The separation line L3 traverses this wall to meet with separation line L4 of a right (left in FIGS. 3–5) half of the outer wall portion 46.

Horizontal parts of the separation lines L1 and L2 are each bent at a right angle, and reside on, or define, upper and lower horizontal separation planes S1 and S2, respectively. Likewise, the separation lines L3 to L5 define a horizontal separation plane S3. The upper separation plane S1 passes, or include lengths of centerlines of, wire insertion holes 48 in the upper array. The lower separation plane S2 passes, or include lengths of centerlines of, wire insertion holes 48 in the lower array.

The two principal parts are called: "upper outer housing" 50 and "lower outer housing" 51. The upper and lower outer housings 50 and 51 are separable from each other. To avoid an occasional separation of the upper and lower outer housings 50, 51, there is formed on their outside a combination of a lock frame 52 and a lock protrusion 53 engageable with the lock frame 52 to hold a closed state of the outer housing 4.

The wire insertion holes 48 are formed through the bottom wall portion 47 in opposition to the terminal accommodation chambers 13, so that they correspond in location to the rubber plug insertion holes 43 of the spacer 5. When the connector 2 is assembled, the retained portion 56 of the rubber plug 6 contact watertight, at a front side thereof on an entire rear surface of the rubber plug retaining portion 41 of the spacer 5, and at a rear side thereof on an entire front surface of the bottom wall portion 47 of the outer housing 4.

As shown in FIG. 4, the bottom wall portion 47 of the outer housing 4 is divided along separation lines L1 to L3 into three parts: a bottom wall upper portion 47*a*, a bottom wall intermediate portion 47*b*, and a bottom wall lower portion 47*c*. The bottom wall upper portion 47*a* is formed as an integral part of the upper outer housing 50, and the bottom wall lower portion 47*c* is formed as an integral part of the lower outer housing 51. The bottom wall intermediate portion 47*b* intervenes between the bottom wall upper portion 47*a* and the bottom wall lower portion 47*c*.

As shown in FIGS. 4 and 5, the bottom wall upper portion 47*a* and the bottom wall intermediate portion 47*b* are adapted to open and close relative to each other, about a hinge 54 connecting them to each other. Likewise, the bottom wall lower portion 47*c* and the bottom wall intermediate portion 47*b* are adapted to open and close relative to each other, about another hinge 54 connecting them to each other. When they open, associated wire insertion holes 48 are each divided in two. The bottom wall portion 47 is divided so that the bottom wall upper portion 47*a* and the bottom wall intermediate portion 47*b* neighboring thereto cause wire insertion holes 48 in upper arrays to be each divided into upper and lower halves, and the bottom wall intermediate portion 47*b* and the bottom wall lower portion 47*c* neighboring thereto cause wire insertion holes 48 in lower arrays to be likewise divided into upper and lower halves.

The outer wall portion 46 of the outer housing 4 has an upper wall integrally formed with a flexible lock arm 55, which is formed with a with a locking hole 55*a* removably engageable with a locking projection M3 formed on a hood M2 of the mating connector M.

The waterproof rubber plug 6 comprises a pair of upper and lower arrays of cylindrical rubber plug portions 44, and a retained common base portion 56 interconnecting to integrate the rubber plug portions 44 with each other. The rubber plug portions 44 are pushed to be fitted tight in the rubber plug insertion holes 43. The rubber plug portions 44 correspond in location and number to the rubber plug insertion holes 43. A wire insertion hole or wire leading hole 57 is axially provided through a respective rubber plug portion 44 and an associated part of the base portion 56, normally allowing for an insulated electric wire 20 to be inserted therein to be lead through a corresponding plug insertion hole 43 into a corresponding terminal accommodation chamber 13. Each wire leading hole 57 match in position to and communicates with a corresponding wire insertion hole 48 of the outer housing 4, allowing for the wire 20 to be directly inserted from outside.

The base portion 56 of the waterproof rubber plug 6 is similar in configuration to the bottom wall portion 47, and is sandwiched between the bottom wall portion 47 and the rubber plug retaining portion 41 of the spacer 5, thus abutting watertight on both of them. By such arrangement, the waterproof rubber plug 6 is kept from falling, or retained stable.

There will be described assemblage of the waterproof connector 2.

Terminals 14 of insulation displacement type are inserted in the box portion 12*a* of the inner housing 12, where they are locked in position by unshown locking projections from the central horizontal wall 12*b*. The waterproof packing 24 is applied to the front end of the spacer 5. Wires 20 are let through wire leading holes 57 of the waterproof rubber plug 6 and rubber plug insertion holes 43 of the spacer 5, and connected to the terminals 14. The inner housing 12 is fitted inside the spacer 5, pulling back the wires 20. The rubber plug 6 is slid forward along the wires 20, so that plug portions 44 are guided to be applied to rubber plug insertion holes 43. The base portion 56 is pushed forward, forcing the plug portions 44 to tight fit in the insertion holes 43, so that a waterproof inner connector structure is provided. The outer housing 4 is opened, applied on the wires 20, and closed to be locked by engagement between the lock frame 52 and the lock protrusion 53. The inner connector structure is forced into the inner wall portion 45 of the outer housing 4, so that the base portion 56 of the waterproof rubber plug 6 is pinched to be retained by, contacting watertight on, the rubber plug retaining portion 41 of the spacer 5 and the bottom wall portion 47 of the outer housing 4. Wires 20 are allowed to go back through wire insertion holes 48, as the spacer 5 is inserted together with the rubber plug 6 into the outer housing 4.

One may proceed in a different way in accordance with FIG. 1.

The upper outer housing 50 and the lower outer housing 51 are closed and locked, with the lock frame 52 and the lock protrusion 53 engaged with each other, so that the outer housing 4 has a complete form. The waterproof packing 24 is applied to the front end of the trunk portion 40 of the spacer 5. Terminals 14 are inserted to be set in the box portion 12*a* of the inner housing 12. Wires 20 are applied to the wire insertion holes 48 of the outer housing 4, and are inserted and lead through the wire leading holes 57 of the waterproof rubber plug 6 and rubber plug insertion holes 43 of the spacer 5, to be connected at their non-stripped ends to the terminals 14 of insulation displacement type. The waterproof rubber plug 6 is installed into depth of the inner wall portion 45 of the outer housing 4, so that the base portion 56 seats on inside of the bottom wall portion 47. Then, the spacer 5 is pushed into the inner wall portion 45 of the outer housing 4, so that the base portion 56 of the waterproof rubber plug 6 is sandwiched between, fitting watertight on, the rubber plug retaining portion 41 of the spacer 5 and the bottom wall portion 47 of the outer housing 4. Concurrently, rubber plug portions 44 of the water rubber plug 6 are forced into rubber plug insertion holes 43 of the rubber plug retaining portion 41, so that corrugated tubular bodies of the plug portions 44 are compressed, contacting watertight on inner circumferences of the insertion holes 43. The inner housing 12 is fitted in the trunk portion 40 of the spacer 5, with the packing 24 fixed between the pressing ribs 38 and 42.

As the tubular bodies of plug portions 44 are compressed, corrugated inner circumferences of the wire leading holes 57 have reduced diameters intermittently contacting watertight on the wires 20.

As well as the inner housing 12 to be locked to the spacer 5, the spacer 5 is locked to the outer housing 4 by engagement between unshown integral locking pawl and groove or hole formed thereon or therein.

When the base portion 56 of the waterproof rubber plug 6 is retained between the spacer 5 and the bottom wall portion 47 of the outer housing 4, all the rubber plug portions 44 are conformally applied to the plug insertion holes 43 of the rubber plug retaining portion 41, in a facilitated manner without needing their individual applications.

Further, as the common base portion 56 is secured between the spacer 5 and the bottom wall portion 47, the rubber plug portions 44 are kept from slipping out, with an ensured waterproof performance.

In disassembly such as for damaged outer housing 4 to be replaced with new one or for routine checks, the lock frame 52 is disengaged from the lock protrusion 53 to allow the upper and lower outer housings 50 and 51 to be free in hinge motion or separation along the separation line L1 to L5 or separation plane S1 to S3. When separated, as illustrated in FIG. 5, the bottom wall portion 47 is divided into the bottom wall upper portion 47*a* as integral part of the upper outer housing 50, the bottom wall lower portion 47*c* as integral part of the lower outer housing 51, and the bottom wall intermediate portion 47*b* disposed therebetween. The separation makes all wire insertion holes 48 halved to be open, rendering wires 20 in free of obstacles for the operator to access or remove. Accordingly, the outer housing 4 can be removed without disconnecting the terminals 14 nor cutting the wires 20, thus permitting a facilitated maintenance service.

Normally, the inner and outer wall portions 45 and 46 can be handled as a single piece (i.e. the outer housing 4), that permits easy assembly and facile handling.

It will be seen that each terminal 14 may be any applicable type else, such as a solder-less terminal.

There will be given complementary description for comprehension of the embodiment.

The box portion 12*a* of the inner housing 12 is open at its rear end for communication with inside of the trunk portion 40 of the spacer 5, has in its front wall a pair of upper and lower arrays of terminal insertion holes for insertion of male terminals M1 of the mating connector M. A respective terminal accommodation chamber 13 is defined by an upper or lower wall and the front wall of the box portion 12, the central horizontal wall 12*b*, and a pair of upper or lower neighboring partition walls 12*c* formed on the horizontal wall 12*b*.

The horizontal central wall 12*b* abuts at its rear end on a wall region between the upper and lower arrays of rubber plug insertion holes 43, and has a thickness equivalent to a vertical distance between a bottom of a respective upper insertion hole 43 and a top of a corresponding insertion hole 43.

Each partition wall 12*c* has a smaller length than a distance between an inside of the front wall of the box portion 12*a* and a front side of the rubber plug retaining portion 41 of the spacer 5, when the connector 2 is assembled. The partition walls 12*c* have an identical height to part of a respective terminal accommodation chamber 13 defined by the box portion 12*a*.

A respective female terminal 14 comprises a wire connection portion formed with a pair of side blades for insulation displacement contact with a core of an insulated electric wire 20, and a hollow contact portion for conductive contact with an plugged contact portion of the male terminal M2.

The corrugated wall of a respective wire leading hole 57 is cooperative with a wire 20 lead therethrough to make a series of water sealing gates along the wire 20, when compressed by a forced insertion of an associated plug portion 44 into a corresponding rubber plug insertion hole 43. The wire 20 can be slid by drawing, while keeping effective watertight sealing property.

A horizontal extension of the separation plane S1 or S2 includes centerlines of respective upper or lower wire insertion holes 48 in the bottom wall portion 47 of the outer housing 4, centerlines of respective corresponding wire leading holes 57 of the waterproof rubber plug 6 in a normally installed portion, centerlines of respective corresponding rubber plug insertion holes 43, a centerline between the pair of insulation-cutting blades of a respective corresponding terminal 14 in a normally installed position, a centerline of the contact portion of the terminal 14, and centerlines of respective corresponding terminal insertion holes in the front wall of the box portion 12*a* of the inner housing in a normally installed position.

The waterproof rubber plug 6 comprises a plurality of individual rubber plug portions 44 inserted in and brought into watertight contact with a rubber plug retaining portion 41, and a retained base portion 56 contacting watertight on a spacer 5 and a bottom wall portion 47 of an outer housing 4. The retained portion 56 interconnects the rubber plug portions 44 to be held between the spacer 5 and the bottom wall portion 47, so that the waterproof rubber plug 6 is fixed. The plurality of rubber plug portions 44 are simultaneously inserted in the rubber plug retaining portion 41. It is unnecessary to insert the rubber plug portions 44 individually. The waterproof rubber plug 6 can thus be attached with ease. As the retained portion 56 is held between the spacer S and the bottom wall portion 47, the rubber plug portions are kept from slipping out, with an ensured waterproof performance.

Further, as the bottom wall portion 47 of the outer housing 4 is divided into three parts hinged to each other, the outer housing 4 can be replaced with ease.

While preferred embodiments of the present invention have been described using specific terms, such description is for illustrative purposes, and it is to be understood that changes and variations may be made without departing from the spirit or scope of the following claims.

What is claimed is:

1. A waterproof connector comprising:

an inner housing assembly for defining a terminal accommodation chamber, the inner housing assembly having a first wall formed with a plurality of through holes and a plurality of terminal accommodation chambers defined with the first wall;

a rubber plug member for sealing a wire connection end of the terminal accommodation chamber watertight, the rubber plug member comprising a plurality of plug portions fitted in the plurality of through holes and a connection portion interconnecting the plurality of plug portions and contacting at one side thereof on the first wall; and an outer housing member fifted on the inner housing assembly for holding the rubber plug member, the outer housing member being formed with a wire insertion hole and separable along a separation line passing the wire insertion hole, and the outer housing member having a second wall contacting on another side of the connection portion and formed with a plurality of wire insertion holes.

2. The waterproof connector of claim 1, wherein the outer housing member comprises:

a first housing portion and a second housing portion separable from each other along the separation line; and a hinge element provided between the first housing portion and the second housing portion.

3. A waterproof connector comprising:

an inner housing formed with terminal accommodation chambers for accommodating therein terminals at ends of electric wires;

an outer housing fitted on the inner housing, the outer housing having a bottom wall portion formed with wire insertion holes in opposition to the terminal accommodation chambers;

a waterproof rubber plug interposed between the inner housing and the bottom wall portion for sealing the terminal accommodation chambers;

a spacer having a trunk portion fitted on the inner housing and adapted to be fitted together with the inner housing into the outer housing, and a rubber plug retaining portion for retaining the waterproof rubber plug plugged thereto to be supported in a close contacting manner; and the bottom wall portion being separable along a separation plane passing the wire insertion holes.

4. The waterproof connector of claim 3, wherein the waterproof rubber plug comprises:

rubber plug portions individually inserted tight in the rubber plug retaining portion; and a retained base portion integrally interconnecting the rubber plug portions with each other and pinched tight between the bottom wall portion and the spacer.

5. The waterproof connector of claim 3, wherein:

the outer housing is divided into an upper outer housing and a lower outer housing;

the bottom wall portion comprises a bottom wall upper portion integrally formed with the upper outer housing, a bottom wall lower portion integrally formed with the lower outer housing, and a bottom wall intermediate portion intervening between the bottom wall upper portion and the bottom wall lower portion; and the bottom wall upper portion, the bottom wall intermediate portion and the bottom wall lower portion are each adapted to open relative to a neighboring one of them, by a hinge element therebetween.

* * * * *

UNITED STATES PATENT AND TRADEMARK OFFICE

CERTIFICATE OF CORRECTION

PATENT NO. : 6,343,952 B1
DATED : February 5, 2002
INVENTOR(S) : Masaru Fukuda

It is certified that error appears in the above-identified patent and that said Letters Patent is hereby corrected as shown below:

Column 8,
Line 47, “fifted” should read -- fitted --.

Signed and Sealed this

Sixteenth Day of July, 2002

*Attest:*

*Attesting Officer*

JAMES E. ROGAN
*Director of the United States Patent and Trademark Office*